US005227950A

United States Patent [19]

Twerdochlib

[11] Patent Number: 5,227,950

[45] Date of Patent: Jul. 13, 1993

[54] SHAFT GROUNDING BRUSH AND HOLDER

[75] Inventor: Michael Twerdochlib, Oviedo, Fla.

[73] Assignee: Westinghouse Electric Corp., Pittsburgh, Pa.

[21] Appl. No.: 662,643

[22] Filed: Mar. 1, 1991

[51] Int. Cl.[5] ..... H05F 3/00; H01R 39/38; H01R 39/40

[52] U.S. Cl. ..... 361/221; 310/239; 310/242; 310/248

[58] Field of Search ..... 361/221, 220, 212; 439/2, 11, 13, 18-30; 310/239, 241, 242, 244, 245, 246, 248, 249

[56] References Cited

U.S. PATENT DOCUMENTS

| | | | |
|---|---|---|---|
| 1,422,188 | 7/1922 | Dorffel | 310/244 |
| 2,753,477 | 7/1956 | Yahn et al. | 310/239 |
| 4,277,708 | 7/1981 | McNab et al. | 310/228 |
| 4,749,899 | 6/1988 | Ishazawa et al. | 310/244 |

*Primary Examiner*—A. D. Pellinen
*Assistant Examiner*—Fritz M. Fleming
*Attorney, Agent, or Firm*—M. G. Panian

[57] ABSTRACT

A brush assembly for providing contact between a grounding brush and a rotating shaft, in which the non-contact time associated with brush bounce is reduced. A brush is provided which is fixed to a pivotable arm, with a bias force applied to the arm, such that when the brush is bounced from a shaft as a result of vibration or shaft wobbling, the bias force will reestablish contact between the brush and shaft. Rolling contact between a negator spring and the arm is also provided for reducing friction associated with contact between the spring and pivotable arm. Due to the reduced friction provided by the rolling contact, and more significantly by the pivotal mounting of the arm to which the brush is fixed, the response of the assembly in reestablishing contact with the shaft is greatly improved.

27 Claims, 2 Drawing Sheets

SHAFT GROUNDING BRUSH AND HOLDER

TECHNICAL FIELD

The invention relates to turbine generator systems and in particular, to a shaft grounding brush for a turbine generator shaft. More specifically, the present invention relates to an improved grounding brush which more effectively removes charges from the shaft of a turbine generator system.

BACKGROUND

In a typical turbine generator system, a series of turbines are utilized to produce relative rotational movement between an armature and field for producing electricity. It is known that during generation of electricity, various charges build up on the turbine-generator shaft. The charges can cause arcing from the shaft to the bearings of the turbine-generator, which after a prolonged period can result in the bearings inability to maintain a sufficient film of oil for support of the shaft. When the bearing is unable to maintain an adequate oil film, catastrophic failure occurs in the form of a bearing wipe.

In a turbine, a shaft is provided for transmitting mechanical power, with the shaft passing from a high pressure internal turbine environment to the relatively low pressure ambient. To isolate the high pressure interior, a seal is provided about the shaft. In older turbines, a water seal was utilized, with water pumped under pressure about the shaft, thereby forming a fluid seal about the shaft to isolate the turbine interior from the ambient. While it was generally not recognized, the water also served to conduct current and charges away from the shaft, thereby preventing charges from accumulating on the shaft. In more recent turbines, steam, rather than water, has been utilized for providing a fluid seal. While steam is effective in providing a pressure seal, it is ineffective in dissipating charges which accumulate on the turbinegenerator shaft. In many installations, the problems associated with accumulation of charge on the generator shaft were not recognized, and bearing wipes, or burning out of the bearings occurred.

In the turbine bearings, a thin film of oil, on the order of 5–6 mils, supports the shaft or journal for rotation in the bearing. Generally, very small flakes of metal are also present in the lubrication oil. The metal flakes can aid in arcing across the film when a charge accumulates on the shaft. When arcing occurs, the bearing surface is degraded (often referred to as frosting), reducing the ability to maintain an adequate lubrication film thickness. The degradation of the bearing generally goes unnoticed, until a catastrophic bearing wipe occurs, resulting in complete destruction of the bearing and requiring downtime of the system for costly repairs.

Charges can accumulate on the generator shaft from a number of sources. The largest sources are high impedance electrostatic charges, and low impedance dissymmetry voltages. Smaller charges are also present, such as a high impedance exciter voltages, which are produced as large spikes resulting from exciter current switches, and small homopolar currents, which are generated in the bearing. The latter may be easily eliminated by demagnetizing the generator shaft. The high impedance charges result from an electrostatic charge transfer to the shaft. The low impedance, higher current sources, typically dissymmetry voltages are built up within shaft within the generator and must be prevented from reaching the turbines/bearing sites.

In order to prevent the accumulation of charges, brushes have been provided on the generator shaft between the final (low pressure) turbine stage and the generator. The brushes remove the electrostatic charges, and establish a zero point for the dissymmetry voltage. In establishing the zero point of the dissymmetry voltages, arcing at the turbine bearings is prevented, since the charges will be zero along the shaft from the brush to the turbine governer end. While the dissymmetry voltage will still be present extending from the brush to the generator and the exciter, the generator and exciter bearing pedestals are insulated. The provision of insulated bearings for the turbines is too costly, particularly since more bearings are needed for the turbines than for the generator and exciter.

The charges on the shaft build up quite rapidly. For example, the electrostatic charges will have about 10–20 milliamps current and can accumulate charge at a rate of 30,000 volts per second. The dissymmetry voltages will typically be 10–20 volts, but may be as high as 100 volts, and can have a high associated current. A shaft voltage of 10 volts or even less can be sufficient to cause arcing. Thus, when a grounding brush leaves the shaft for only a short time arcing can occur. It is therefore extremely important to provide substantially continuous contact of the brush with the generator shaft.

In existing brush arrangements, often a brush holder arm is provided which is mounted upon a stud. The brush arm includes a box portion through which the brush is slidably mounted, with a spring resiliently urging the brush towards the shaft. Due to vibrations imparted to the stud, and slight wobbling of the shaft, the brush often bounces away from the shaft, with the spring acting to return the brush to the shaft. A typical turbine generator system will include a pair of brushes, so that one of the brushes can ground the shaft even if the other is temporarily bounced from the shaft. However, the brushes can be bounced from the shaft at the same time, particularly since the studs upon which the brush holder arms are mounted can often vibrate in phase.

In the conventional system, while the spring force causes the brush to regain contact with the shaft, friction associated with the sliding mount of the brush can slow the ability of the brush to return to the shaft and reestablish contact. The slowness of return can be sufficient to allow charge to accumulate and cause arcing. Due to the rapid build up of charge on the shaft, it is preferable to maintain the period of time during which the brush is out of contact to a maximum of 100 microseconds. In the conventional brush arrangement, often the brush is out of contact for periods on the order of milliseconds or large fractions of milliseconds. The occurrence of arcing is generally unnoticeable, as is the slow degradation in the bearing surface. However, after a prolonged period of arcing, the bearing will be unable to provide a sufficient oil film and a catastrophic failure can result.

Thus, a brush which is capable of removing charges from the generator shaft is needed, in which the period of time in which the brush is out of contact with the generator as a result of brush bounce is minimized, thereby eliminating or reducing arcing in the bearings.

SUMMARY AND OBJECTS OF THE INVENTION

In accordance with the present invention, Applicant has recognized that friction, associated with the sliding brush arrangement of the prior art, can slow the return of the brush to the generator shaft. The delay in restoring contact between the brush and shaft can result in sufficient charge accumulation on the shaft to cause arcing between the shaft journal and the bearing. By eliminating the friction associated with returning the brush to the shaft after it has bounced from the shaft, contact can rapidly be reestablished, thereby preventing charge accumulation and the associated destruction of the bearing metal which supports the oil film.

In the present invention, the brush is fixedly mounted to a brush holder arm, with the spring providing a restoring force acting on the brush holder arm. With the spring force acting on the arm, and no relative movement between the brush and the arm, the frictional contact associated with the (prior art) brush sliding in a box is avoided. The arm in the present invention is also provided with a knife edge which pivots on a mounting bracket, such that negligible friction is associated with movement of the brush arm as the brush is bounced from the shaft and returned toward the shaft by the spring force.

It is, therefore, an object of the present invention to provide a shaft grounding brush assembly which reduces the amount of time during which the brush is out of contact with the generator shaft as a result of brush bounce.

It is another object of the invention to provide a shaft grounding brush assembly, in which a restoring force is provided to return the brush to the generator shaft after a bounce, without frictional movement between the brush and brush holder.

It is a further object of the present invention to provide a shaft grounding brush assembly in which the brush is fixed to a brush holder arm, with a spring force acting on the brush arm to return the brush toward the generator shaft and reestablish contact between the brush and shaft, with the brush arm mounted on a clamp in a manner which allows substantially frictionless movement of the arm.

It is a still further object of the present invention to provide a brush assembly in which a spring is provided for applying a bias force to a brush holder arm, with the spring mounted in rolling contact with the arm to minimize friction between the spring and arm.

These and other objects and advantages of the present invention will become apparent from the following detailed description read in conjunction with the drawings.

DETAILED DESCRIPTION OF THE PREFERRED EMBODIMENTS

Figure 1:
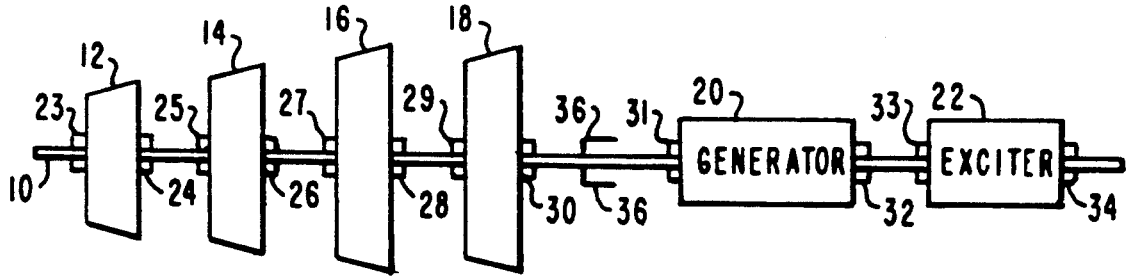
FIG. 1 is a schematic of a turbine generator system.

FIG. 1 shows a typical turbine generator arrangement in which a series of turbines remove energy from steam and produce mechanical energy in the form of a rotating shaft. The rotating shaft is then utilized for producing relative rotation between a magnetic field and armature coils for producing electricity. The standard turbine generator arrangement includes a shaft 10 which extends through the turbines and to the generator and exciter. Typically, the shaft will include a plurality of sections which are coupled together such that during operation, they effectively act as a single shaft 10. Energy is provided for rotating the shaft by a high pressure turbine 12, intermediate pressure turbine 14 and low pressure turbines 16, 18. The shaft passes through the generator 20 and exciter 22 for generating electricity. Suitable bearings 23-30 are provided for supporting the rotating shaft through the turbines with insulated bearings 31-34 provided for supporting the shaft through the generator and exciter.

In typical systems currently in use, a pair of brushes are provided as shown at 36 for grounding charges to the frame of the generator. The brushes remove the electrostatic charges, and establish a zero point for the dissymmetry voltage. While the dissymmetry voltage will still be present to the right of the brushes (i.e. on the generator-exciter side), the dissymmetry voltage is not a problem as the generator and exciter bearings are typically insulated. To the left of the brushes in FIG. 1, the attempt of the brushes is to provide a zero dissymmetry voltage so that it does not effect the uninsulated turbine bearings 23-30. Since the brush removes the electrostatic charge, and zeros the dissymmetry voltage for portions of the shaft to the left of the brush, it is only necessary to place the brush or brushes at a single location along the shaft 10, namely between the low pressure turbine 18 and the generator 20.

The brushes are generally mounted on studs provided on the turning gear cover, with a stud of approximately 3/4 inches in diameter provided for each brush. Due to vibration of the studs, and also wobbling or slight imperfections of the shaft, the brush can be momentarily separated from the shaft. As discussed earlier, due to the quite rapid accumulation of the charges, and since arcing in the turbine bearings can occur quite rapidly, it is extremely important to minimize the time in which the brush is not in contact with the shaft. While the use of a pair of brushes can help in decreasing periods of time in which a brush is not in contact, often the brushes are simultaneously bounced, since the studs upon which the brushes are mounted often vibrate in phase with each other.

Figure 2:
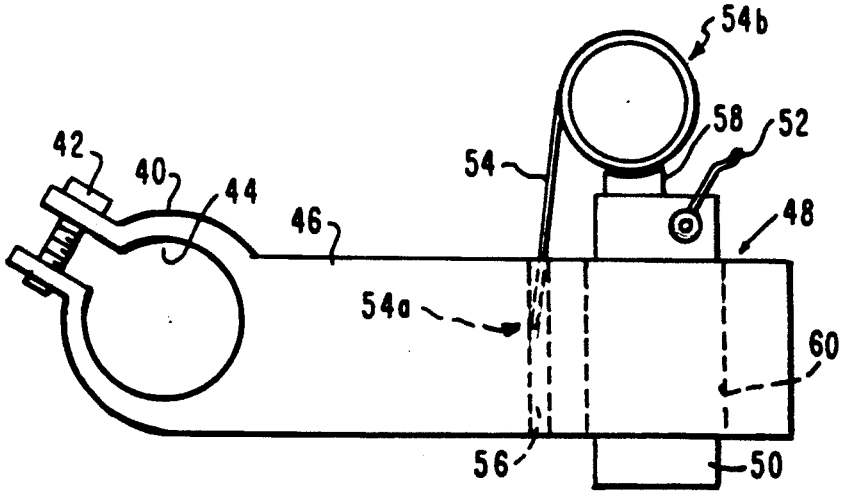
PRIOR ART FIG. 2
FIG. 2 illustrates a shaft grounding brush and brush arrangement of the prior art.

FIG. 2 shows a brush assembly typical of those currently in use, which includes a spring for maintaining the brush in contact with the generator shaft, and for returning the brush towards the shaft to reestablish contact after the brush has been bounced from the shaft. As shown in FIG. 2, the brush assembly includes a clamping device 40 having a screw or bolt 42 which allows clamping of the brush assembly about a stud which is received in an aperture 44. An arm portion 46 provides a rigid support between the clamp and a box portion 48 having an aperture which receives the brush 50. The brush 50 is typically a carbon brush which is rigid and can remove a charge from the shaft, with the charge transferred back to the generator frame by wires connected to the brush shown at 52.

To allow for brush bounce without causing loosening of the clamp about the stud, a spring 54 is provided in the form of a negator spring. The negator spring includes a first end 54*a* which is received in a slot 56 of the arm 46. The end 54*a* is fixed to the arm by a screw, rivet or other suitable means. The other end of the spring is tightly wound upon itself to form a loop. While the loop is shown as a single layer, it is to be understood that multiple layers are wound into the loop with the spring force tending to cause the loop is seated on a stand or pedestal 58. The pedestal 58 includes a curved top for seating the loop 54*b* thereon. Thus, the negator spring will apply a downward force to the brush 50, and urge the brush into contact with the shaft.

The box portion 48 of the brush assembly includes an aperture or slot 60 extending through the arm 46 for slidably receiving the brush 50. In operation, as the brush is bounced from the shaft (either by vibration of the stud pulling the arm from the shaft, or by shaft wobble or vibration pushing the brush from the shaft), the negator spring will roll upon itself, thereby causing a downward movement of the brush 50 to reestablish contact with the shaft. The rolling of the spring upon itself, is resisted by friction associated with the sliding contact between the loop 54*b* and the pedestal 58. Even more significantly, sliding contact between the brush 50 and the interior surface of the box also slows the reaction time of the assembly in reestablishing contact of the brush with the rotating shaft. The response of the brush can be slowed further as the brush becomes worn (grooved) as a result of the sliding contact in the box such that the surface contact and associated friction increases. The elapsed time in which contact is not established can often be on the order of milliseconds or large fractions of milliseconds. Due to the extremely rapid accumulation of charge on the shaft, and since arcing in the bearings can result from only a 5 to 10 volt charge, the response time of the conventional assembly is clearly less than satisfactory. Over an extended period of time, arcing can cause the surface of the bearings to become frosted, reducing the ability to support a film thickness for support of the journal. Merely increasing the spring force has not provided a satisfactory solution, since where a greater spring force is applied, the reaction force tending to push the brush away is greater, such that the elapsed time required to reestablish contact between the brush and shaft is not effectively reduced. Moreover, when the force of the brush against the shaft is increased, the brush in contact with the shaft will wear more rapidly.

Figure 3:
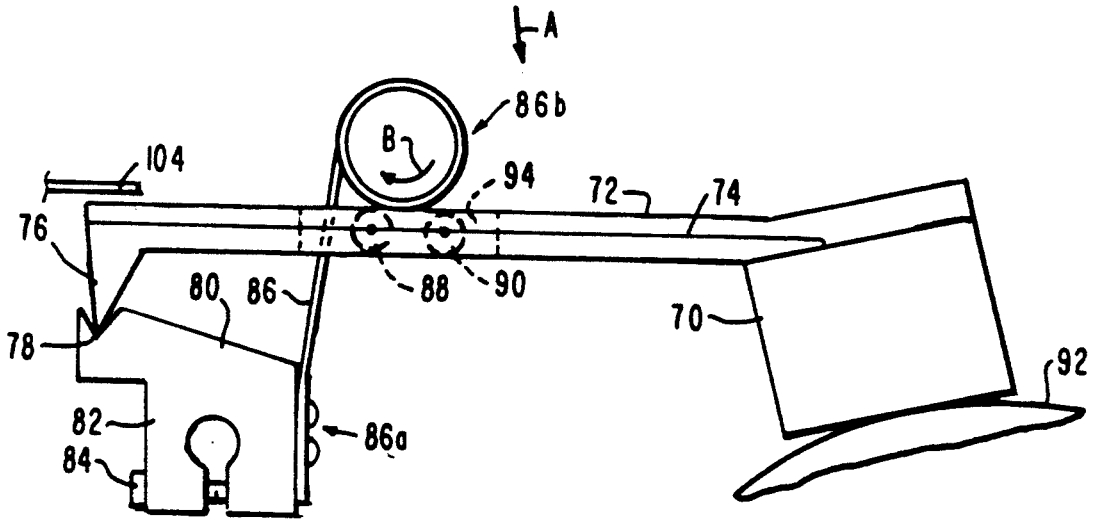
FIG. 3 illustrates a brush assembly of the present invention.

In accordance with the present invention, Applicant has recognized the importance in reducing friction in providing a brush which more rapidly responds to brush bounce. In accordance with the present invention, the friction associated with the sliding brush and box arrangement has been eliminated. In addition, friction associated with the contact of the spring during return movement has also been substantially eliminated. As shown in FIG. 3, the brush assembly of the present invention includes a brush 70 which is fixedly mounted to a brush holder arm 72. In order to conduct the charge from the brush back to the frame of the generator, a connector is provided, which can be a wire 74 running through or along the outside of the arm 72.

The brush 70 can be a rigid carbon brush such as those utilized in prior art designs, however in accordance with one advantage of the present invention, the brush 70 may comprise a plurality of wires which contact the generator shaft. A wire brush can be advantageous in that multiple contacts are provided between the wires and shaft, and the wires will flex to dampen any forces tending to cause brush bounce. Wire brushes would not be suitable in conventional assemblies, since the wires could get caught or hung-up within the box of the brush holder. In the present invention, the brush, either carbon or multiple wire, is fixed to the arm and may be attached by a screw, epoxy or other suitable adhesives or fasteners.

At one end of the arm 72, a pivoting edge portion 76 is provided in the form of a V-shaped edge which is seated in a corresponding V-shaped slot or groove 78 provided on a mounting bracket 80. The edge portion 76 thus provides a knife edge mounted on the bracket 80, thereby providing a pivotal mount for the arm 72, with small or negligible friction associated with the pivotal movement at the edge 76. The bracket 80 includes a clamping portion 82 having a tightening screw or bolt 84 to allow mounting of the bracket on a stud.

To apply a biasing force on the arm, a negator spring 86 is provided having a first end 86*a* fixed to the mounting bracket 80. The second end of the negator spring includes a looped portion 86*b*, with the spring force causing the spring to roll upon itself as shown by arrow B. In accordance with one aspect of the present invention, the friction associated with the movement of the looped portion in rolling upon itself to reestablish contact of the brush 70 and shaft is substantially eliminated, with rolling contact (between the spring and brush holder arm) provided rather than the sliding contact of the prior art. In particular, a pair of rollers 88, 90 are provided, upon which the loop of the spring 86*b* is seated. As the spring rolls upon itself, the roller 88, 90 will rotate thereby providing rolling contact between the loop 86*b* and rollers 88, 90. Thus, friction is reduced, as compared to the sliding contact of the pedestal arrangement of the prior art and the spring thus responds more quickly in reestablishing contact between the brush and shaft.

In operation, when contact is lost between the brush 70 and the shaft 92, either as a result of vibration of the stud or wobbling of the shaft 92, the spring force will cause the loop 86*b* to roll upon itself and the bias force applied against the arm 72 through the rollers causes the arm 72 to pivot about the pivot mount (76, 78) to reestablish contact between the brush 70 and shaft 92. It should be apparent that in accordance with the present invention, the friction associated with the sliding contact between the brush and arm, and the sliding contact between the spring and pedestal of the prior art are eliminated. As a result, the elapsed time during which the brush is out of contact can be reduced to an acceptable period of time. Thus, it is possible to utilize a single brush in lieu of the double brush arrangement of the prior art, however, for even further safety, it is contemplated that a pair of brushes may also be utilized in accordance with the present invention.

Figure 4:
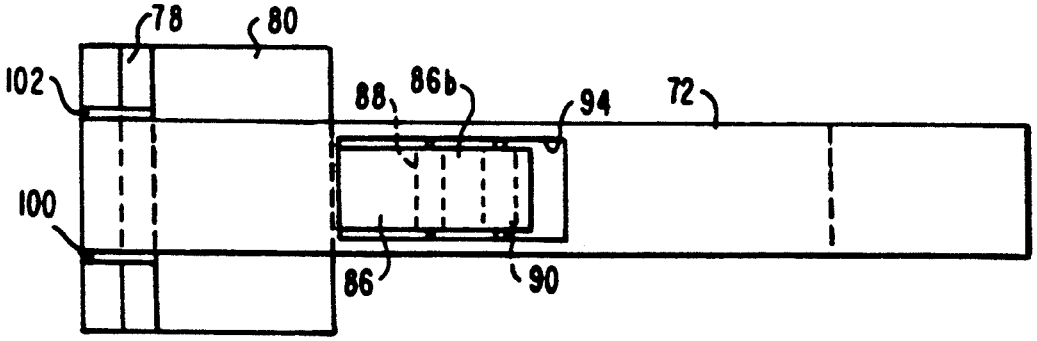
FIG. 4 shows a top view of the brush assembly of FIG. 3.

FIG. 4 shows a top view of the embodiment of FIG. 3, as viewed from the direction of arrow A (FIG. 3). As shown in FIG. 4, the arm 72 includes a slot or aperture 94 for accommodating the rollers 88, 90 upon which the spring is mounted. The negator spring extends up through the aperture, with the looped portion seated upon the rollers 88, 90 within the aperture 94 of the arm.

The rollers are spaced sufficiently to provide for stable seating of the loop of the negator spring.

To prevent lateral movement of the arm 72 along the slot 78 of the bracket 80, a pair of stops 100, 102 (omitted from FIG. 3 for clarity may be provided along the groove as shown in FIG. 4. The stops will prevent movement of the arm along the slot due to vibrations. In lieu of stopping walls 100, 102, the groove may simply be confined to the central portion into which the edge 76 is seated, with the end walls of the groove acting as the stops 100, 102. In addition, to prevent dislocating of the edge portion 76 from the slot 78, an upper restraint, such as a wall or abutment 104 may be provided to limit the upward movement of the arm as a result of vibration or bounce. Preferably, the abutment 104 would be connected to the mounting bracket 80.

Figure 5:
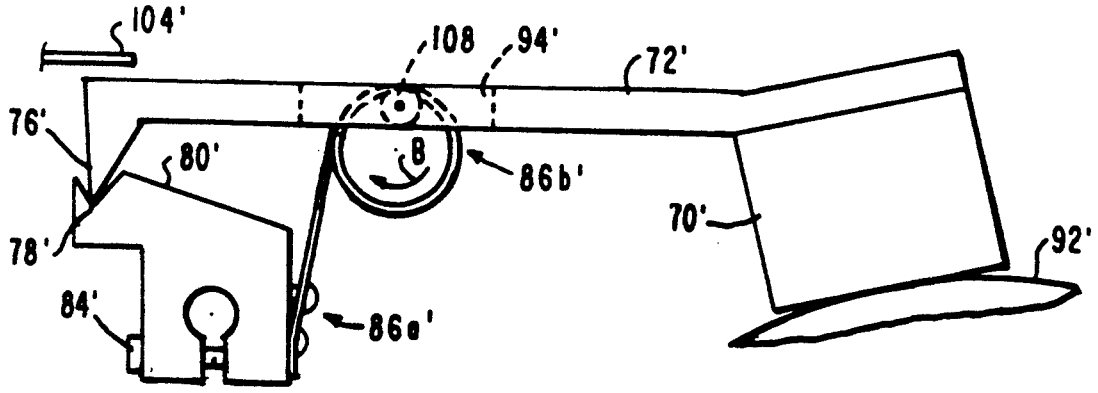
FIG. 5 shows a modified brush and brush holder arrangement in accordance with the present invention.

Turning to FIG. 5 an alternative arrangement in accordance with the present invention is shown. In the embodiment of FIG. 5, a single roller is provided to establish the rolling contact between the negator spring and the brush holder arm 72'. In particular, the arm 72' includes an aperture 94' in which a roller 108 is provided. The negator spring is fixed to a bracket at a first end **86*a*', with the looped portion 86*b*' extending into the aperture, and the roller 108 extending through the loop. As the brush 70' bounces from the shaft 92', as a result of shaft wobbling or vibrations, the inner surface of the loop 86*b*' will move in rolling contact with the roller 108, as the loop portion rolls upon itself as indicated by arrow B. The arm 72' will thus pivot about the pivot mount 76', 78', and the brush 70' will reestablish contact with the shaft 92'**.

Industrial Applicability

The invention provides a brush assembly which rapidly responds to brush bounce in order to reestablish contact between a brush, for example a grounding brush, and a rotating shaft. By reducing the friction associated with reestablishing contact between the brush and shaft after the brush has bounced from the shaft, the elapsed time during which the brush is out of contact with the shaft is reduced. While the invention is disclosed as particularly useful in grounding a shaft, it is to be understood that the advantages provided by the present invention may also be utilized wherever it is important to establish contact between a brush and a rotating shaft or other charge source. In accordance with the present invention, a brush arm is pivotally mounted at a first end, with the brush fixed to a second end of the arm. A negator spring is provided in rolling contact with the brush arm, such that after the brush is bounced from the shaft, the loop will roll upon itself, causing the brush arm to pivot about the first end to reestablish contact between the brush and shaft.

I claim:

1. A brush assembly for establishing electrical contact with a rotating shaft comprising:

brush means for contacting a shaft;

an arm including first and second rollers fixedly attached to said brush; and bias means for applying a bias force on said arm to urge said brush means toward the shaft, said bias means including a spring having a first fixed end and a loop at a second end, and wherein said loop is seated on said rollers.

2. A brush assembly of claim 1, further including pivotal mounting means for mounting said arm to pivot as said bias means applies the bias force to cause said brush to establish contact with a shaft after the brush has bounced from the shaft.

3. The brush assembly of claim 2, wherein said pivotal mounting means includes an edge portion of said arm and a bracket having a slot for receiving said edge portion.

4. The brush assembly of claim 3, wherein said edge portion and said slot are V-shaped, wherein the V-shaped arm edge portion is seated in the V-shaped slot.

5. The brush assembly of claim 4, wherein said bracket includes clamping means for clamping said bracket to a stud.

6. The brush assembly of claim 5, wherein said first end is fixed to said bracket.

7. The brush assembly of claim 6, further including connector means for electrically connecting said brush to a ground.

8. The brush assembly of claim 6, wherein said spring is a negator spring.

9. The brush assembly of claim 1, wherein said spring is a negator spring, said assembly further including a bracket having clamping means for clamping said bracket to a stud, and wherein said first end of said spring is fixed to said bracket.

10. The brush assembly of claim 2, further including lateral restraint means for restraining lateral movement of said arm is directions substantially parallel to a pivot axis of said pivotal mounting.

11. The brush assembly of claim 3, further including means for preventing removal of said edge from said slot.

12. The brush assembly of claim 11, further including stop means for restraining lateral movement of said edge portion along said slot.

13. The brush assembly of claim 1, wherein said brush means comprises a carbon brush.

14. The brush assembly of claim 1, wherein said brush means comprise a wire brush.

15. The brush assembly of claim 1, wherein said arm includes a first pivotally mounted end, and a second end to which said brush is fixed.

16. A shaft grounding brush assembly for establishing electrical contact between a brush and a rotating shaft to remove a charge from the shaft, the assembly comprising:

a mounting bracket;

an arm having first and second ends, said arm including roller means located between said first and second ends;

pivotal mounting means for pivotally mounting said arm at the first end;

brush means attached to said arm at said second end; and a negator spring for applying a bias force on said roller means, the negator spring having a first end fixed to said mounting bracket and a second end having a loop in contact with said roller means, thereby providing a bias force for urging said brush into contact with a shaft.

17. The brush assembly of claim 16, wherein said bracket has a slot for receiving an edge portion of said arm, wherein said edge portion is located at the first end of said arm.

18. The brush assembly of claim 17, further including stop means for limiting lateral movement of said arm along said slot.

19. The brush assembly of claim 17, further including means for preventing removal of said edge portion from said slot.

20. The brush assembly of claim 17, wherein said bracket includes clamping means for mounting the brush assembly on a stud.

21. The brush assembly of claim 16 wherein said arm includes a V-shaped edge portion located at the first end of the arm, where said mounting bracket has a slot for receiving the V-shaped edge portion of the arm, thereby forming the pivotal mounting means for mounting the arm upon the bracket.

22. A brush assembly for holding a brush in contact with a shaft comprising:

a bracket having a slot therein;

an arm having an edge portion received by said slot to establish a pivotal mount of said arm on said bracket;

a brush fixed to said arm;

bias means for establishing a bias force on said arm to thereby urge said brush into contact with the shaft; and rolling contact means between said arm and said bias means.

23. The brush assembly of claim 22, wherein said edge portion is V-shaped.

24. The brush assembly of claim 23, wherein said bias means includes a negator spring having a first end fixed to said bracket, and a second end having a loop, said arm including a pair of rollers, comprising said rolling contact means, upon which the loop is seated, thereby establishing rolling contact between the negator spring and the arm.

25. The brush assembly of claim 23, wherein said bias means includes a negator spring having a first end fixed to said bracket, and a second end having a loop, said arm including a roller which extends through the loop of said negator spring, said roller comprising said rolling contact means, thereby establishing rolling contact between said negator spring and second arm.

26. A brush assembly for establishing electrical contact with a rotating shaft comprising:

brush means for contacting the shaft;

an arm fixedly attached to said brush and including a roller thereon; and a spring having a first fixed end and a loop at a second end, the loop receiving said roller therethrough, such that said arm is biased to urge said brush means toward the shaft.

27. The brush assembly of claim 26, wherein said spring is a negator spring, said assembly further including a bracket having clamping means for clamping said brakcet to a stud, and wherein said first end of said spring is fixed to said bracket.

* * * * *